US010244844B2

(12) United States Patent
Lee

(10) Patent No.: US 10,244,844 B2
(45) Date of Patent: Apr. 2, 2019

(54) COSMETIC CONTAINER HAVING APPLICATION MEMBER DETACHABLY ATTACHED TO SIDE OF BUTTON MEMBER

(71) Applicant: PUM-TECH KOREA CO., LTD., Incheon (KR)

(72) Inventor: Do Hoon Lee, Incheon (KR)

(73) Assignee: PUM-TECH KOREA CO., LTD., Incheon (KR)

( * ) Notice: Subject to any disclaimer, the term of this patent is extended or adjusted under 35 U.S.C. 154(b) by 210 days.

(21) Appl. No.: 15/109,805

(22) PCT Filed: Jan. 15, 2015

(86) PCT No.: PCT/KR2015/000418
§ 371 (c)(1),
(2) Date: Jul. 5, 2016

(87) PCT Pub. No.: WO2015/108345
PCT Pub. Date: Jul. 23, 2015

(65) Prior Publication Data

US 2016/0324295 A1 Nov. 10, 2016

(30) Foreign Application Priority Data

Jan. 15, 2014 (KR) ..... 20-2014-0000343 U

(51) Int. Cl.
*B43K 5/02* (2006.01)
*A45D 34/04* (2006.01)
(Continued)

(52) U.S. Cl.
CPC ..... *A45D 34/041* (2013.01); *A45D 34/04* (2013.01); *A61H 7/005* (2013.01);
(Continued)

(58) Field of Classification Search
CPC ..... A45D 34/04; A45D 34/041
(Continued)

(56) References Cited

U.S. PATENT DOCUMENTS 7,497,635 B1 * 3/2009 Bae ..... A45D 34/04 401/123
7,690,854 B2 * 4/2010 Delage ..... A45D 34/042 401/108
(Continued)

FOREIGN PATENT DOCUMENTS

JP 2011-72943 4/2011
KR 10-2010-0010824 2/2010
(Continued)

*Primary Examiner* — Jennifer C Chiang
(74) *Attorney, Agent, or Firm* — Heedong Chae; Lucem, PC

(57) ABSTRACT

A cosmetic container having an application member detachably attached to the side of a button member, according to the present invention, include: a container body (10) having a storage space (13); a pump (20) for discharging the content of the container body (10) to the outside; a cap (30) for fixing the pump (20) to the container body (10); the button member (40) coupled to the upper part of the pump (20) and formed to protrude toward the upper part of the cap (30); and the application member (50) detachably attached to the side of the button member (40).

14 Claims, 7 Drawing Sheets

(51) Int. Cl.

| | |
|---|---|
| ***B05C 17/005*** | (2006.01) |
| ***B65D 41/02*** | (2006.01) |
| ***A61H 15/00*** | (2006.01) |
| ***A61H 7/00*** | (2006.01) |
| *B05B 11/00* | (2006.01) |

(52) U.S. Cl.
CPC ... *A61H 15/0092* (2013.01); *B05C 17/00569* (2013.01); *B65D 41/02* (2013.01); *A61H 2015/0042* (2013.01); *A61H 2201/105* (2013.01); *A61H 2201/1246* (2013.01); *A61H 2201/1635* (2013.01); *A61H 2201/1666* (2013.01); *A61H 2205/022* (2013.01); *B05B 11/3026* (2013.01); *B05B 11/3069* (2013.01); *B05B 11/3074* (2013.01)

(58) Field of Classification Search
USPC ..... 401/188 R, 219, 220
See application file for complete search history.

(56) References Cited

U.S. PATENT DOCUMENTS

| | | | | |
|---|---|---|---|---|
| 8,876,422 | B2 * | 11/2014 | Lim ..... | A45D 34/04 401/188 R |
| 2007/0075097 | A1 | 4/2007 | Behar | |

FOREIGN PATENT DOCUMENTS

| | | |
|---|---|---|
| KR | 20-2011-0010162 | 10/2011 |
| KR | 20-2013-0005766 | 10/2013 |

* cited by examiner

-- Prior Art --

COSMETIC CONTAINER HAVING APPLICATION MEMBER DETACHABLY ATTACHED TO SIDE OF BUTTON MEMBER

TECHNICAL FIELD

The present invention relates to a cosmetic container having an application member detachably attached to the side of a button member and, more specifically, to a cosmetic container having an application member detachably attached to the side of a button member, wherein the application member having an application surface, an ejection hole and a massage ball is provided at the upper part of a container body such that an application portion is massaged while cosmetic contents are applied onto the application portion.

In addition, the present, invention relates to a cosmetic container having an application member detachably attached to the side of a button member, wherein a pump is provided inside the container body and the button member is formed at the upper part of the pump such that, when a button is pressed, a fixed quantity of the cosmetic contents is ejected, thereby providing convenience in use.

Furthermore, the present invention relates to a cosmetic container having an application member detachably attached to the side of a button member, wherein the application member is assembled by being detachably attached to the side of the button member, thereby making it suitable to produce various kinds of products in small quantities, of which the application members have different shapes from one another, and making it easy to attach or change the application members when producing products of which the application members have different shapes from one another, thereby increasing the rate of product production and reducing production costs.

BACKGROUND ART

In general, as a human being ages, the skin function of a human being is deteriorated, so that a spot, a freckle, melisma, a blemish, an age spot and the like, great or small, may be generated on the face of a human being, the skin may be too dried, or a wrinkle may be generated on the skin. Specifically, there may be many people having dark circles around those eyes.

Various medical treatments are performed or various kinds of functional cosmetics are used to prevent various phenomena from occurring on the face skins of people beforehand, or to cover or remove the troubles.

Functional cosmetics which cover a dark circle generated around eyes to allow the dark circle not to be seen are called functional cosmetics. Such eye cream has been produced while various functions of giving effects of moisturizing around eyes, whitening, wrinkle removal, waste product, removal from stratum corneum and the like, expected when used, are added thereto.

However, since the eye cream cosmetics described above must be applied with hands or a separated cosmetic tool of various forms, it is inconvenient to use such eye cream cosmetics.

In addition, since a container for eye cream cosmetics according to the related art is constructed in a simple configuration of a tube container and a lid for opening/closing the tube container and must be pressed to discharge the contents for use when wearing makeup, it is difficult to discharge a fixed amount of cosmetic contents, so that the cosmetic contents may be wasted.

To solve the problems described above, there had been disclosed a dispenser coating member having a coating member and a pump in US Patent Application Publication No. 2007-0075097. As shown in FIG. 1, the dispenser coating member includes a core 1 provided with a spout 4 extending from an upper portion thereof and having a cylindrical shape, a casing provided with an end piece 5 extending from an upper portion thereof and having a cylindrical shape, and a dispenser member 3 movable up or down.

In addition, according to the related art, the core 1 is coupled to an upper portion of the dispenser member 3 and the casing 2 is coupled to the core 1 while surrounding the core 1. In addition, the dispensing passage is formed from the dispenser member 3 to the core 1 and the casing 2, so that the dispenser can dispense a fixed amount of contents through pumping.

However, since the dispensing passage is formed while the core 1 and the casing 2 overlap each other on the dispenser member, the structure and manufacturing process ae complex so that the productivity is deteriorated.

In addition, there is inconvenience for a user to dispense the cosmetic contents and to directly apply the contents in order to apply the contents to an application portion. Further, since any separated massage functions do not exist, there is a problem that the skin cannot effectively absorb the contents.

In addition, since the core 1 and the casing 2 on the dispenser member 3 must be replaced to produce various products of which the shapes of coating members are different from each other in small quantity batch production, the process is complex, so that the dispenser coating member is not suitable for small quantity batch production and the manufacturing cost is increased.

DISCLOSURE

Technical Problem

To solve the problems described above, an object of the present invention is to provide a cosmetic container having an application member detachably attached to the side of a button member, wherein the application member having an application surface, an ejection hole and a massage ball is provided at the upper part of a container body such that an application portion is massaged while cosmetic contents are applied onto the application portion.

Another object of the present invention is to provide a cosmetic container having an application member detachably attached to the side of a button member, wherein a pump is provided inside the container body and the button member is formed at the upper part of the pump such that, when the button is pressed, a fixed quantity of the cosmetic contents is ejected, thereby providing convenience in use.

Still another object of the present invention is to provide a cosmetic container having an application member detachably attached to the side of a button member, wherein the application member is assembled by being detachably attached to the side of the button member, thereby making it suitable to produce various kinds of products in small quantities, of which the application members have different shapes from one another, and making it easy to attach or change the application members when producing products of which the application members have different shapes from one another, thereby increasing the rate of product production and reducing production costs.

Technical Solution

According to the present invention, there is provided a cosmetic container having an application member detachably attached to a side of a button member. The cosmetic container includes:

a container body (10) having a storage space (13);

a pump (20) for discharging contents of the container body (10) to an outside;

a cap (30) for fixing the pump (20) to the container body (10);

the button member (40) coupled to an upper part of the pump (20) and formed to protrude upward of the cap (30); and the application member (50) detachably attached to the side of the button member (40).

The pump (20) comprises a piston (22), a cylinder (24) having a cylindrical shape to allow the piston (22) to be inserted therein, a piston ring (21) interposed between an outer periphery surface of the piston (22) and an inner periphery surface of the cylinder (24), and a check valve (23) installed in the cylinder (24) and formed on a lower portion of the cylinder (24).

The button member (40) is provided on an upper surface thereof with a push protrusion (42).

The button member (40) is provided at one side thereof with a latching groove (43).

The button member (40) is provided at a lower side thereof with a lower extension part (44) and a latching ring protrusion (45) is formed on an end of the lower extended part (44).

The application member (50) comprises a coupling part (51), an ejection, part (52) coupled to an upper end of the coupling part (51), and an application surface (53) coupled to an upper end of the ejection part (52).

The application member (50) is provided at a lower side thereof with a latching protrusion (54).

Advantageous Effects

According to the cosmetic container having an application member detachably attached to the side of a button member of the present invention, the application member having an application surface, an ejection hole and a massage ball is provided at the upper part of a container body such that an application portion is massaged while cosmetic contents are applied onto the application portion.

In addition, according to the cosmetic container having an application member detachably attached to the side of a button member of the present invention, the pump is provided inside the container body and the button member is formed at the upper part of the pump such that, when the button is pressed, a fixed quantity of the cosmetic contents, is ejected, thereby providing convenience in use.

In addition, according to the cosmetic container having an application member detachably attached to the side of a button member of the present invention, the application member is assembled by being detachably attached to the side of the button member, thereby making it suitable to produce various kinds of products in small quantities, of which the application members have different shapes from one another, and making it easy to attach or change the application members when producing products of which the application members have different shapes from one another, thereby increasing the rate of product production and reducing production costs.

BEST MODE

Mode for Invention

Hereinafter, a cosmetic container having an application member detachably attached to the side of a button member according to an embodiment of the present invention will be described with reference to accompanying drawings.

Figure 1:
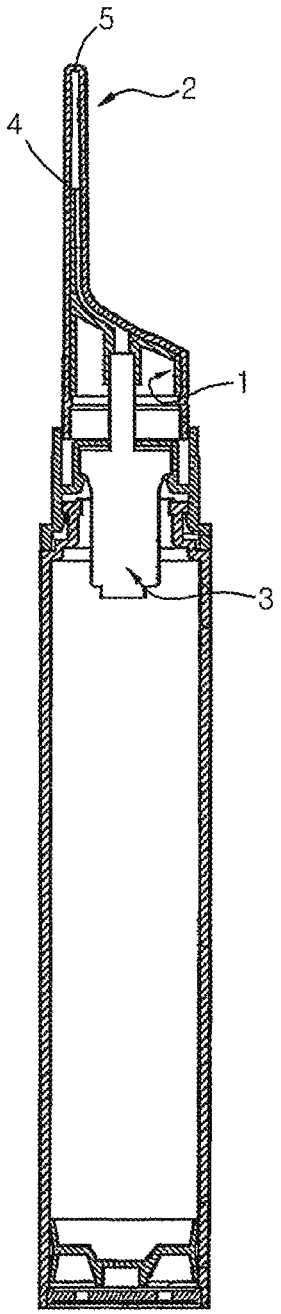
FIG. 1 is a sectional view of a cosmetic container according to the related art.
Figure 2:
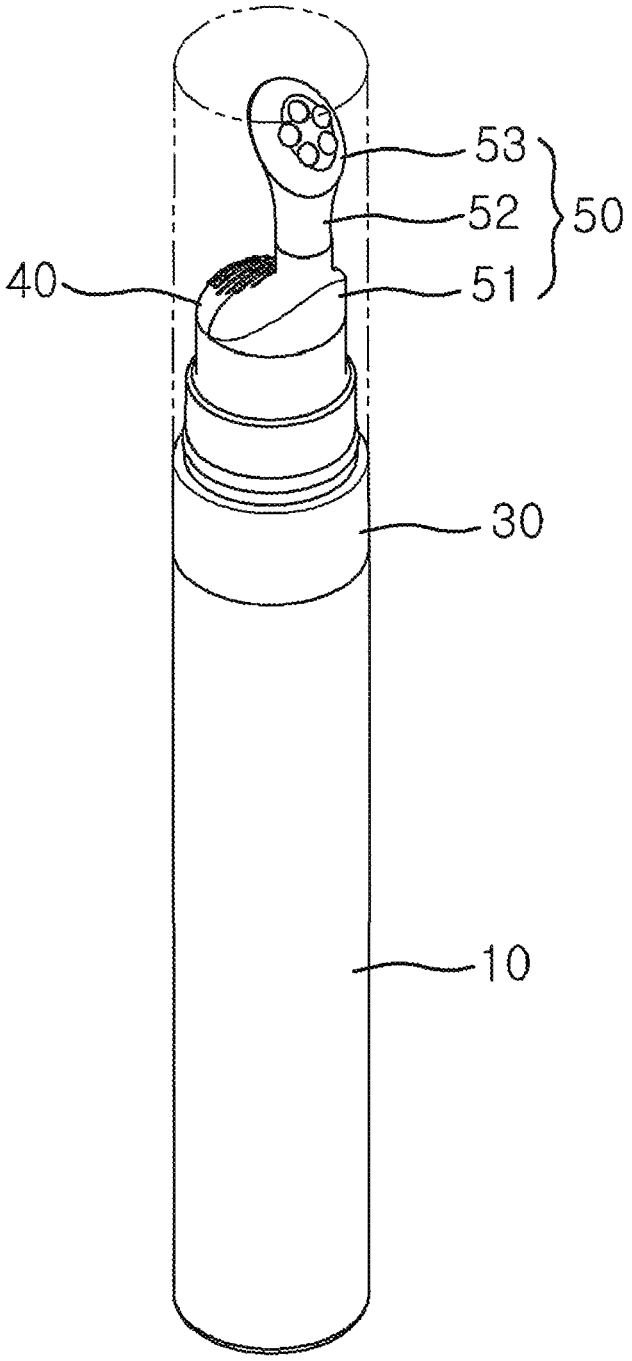
FIG. 2 is a perspective view illustrating a cosmetic container having an application member detachably attached to the side of a button member according to one embodiment of the present invention.
Figure 3:
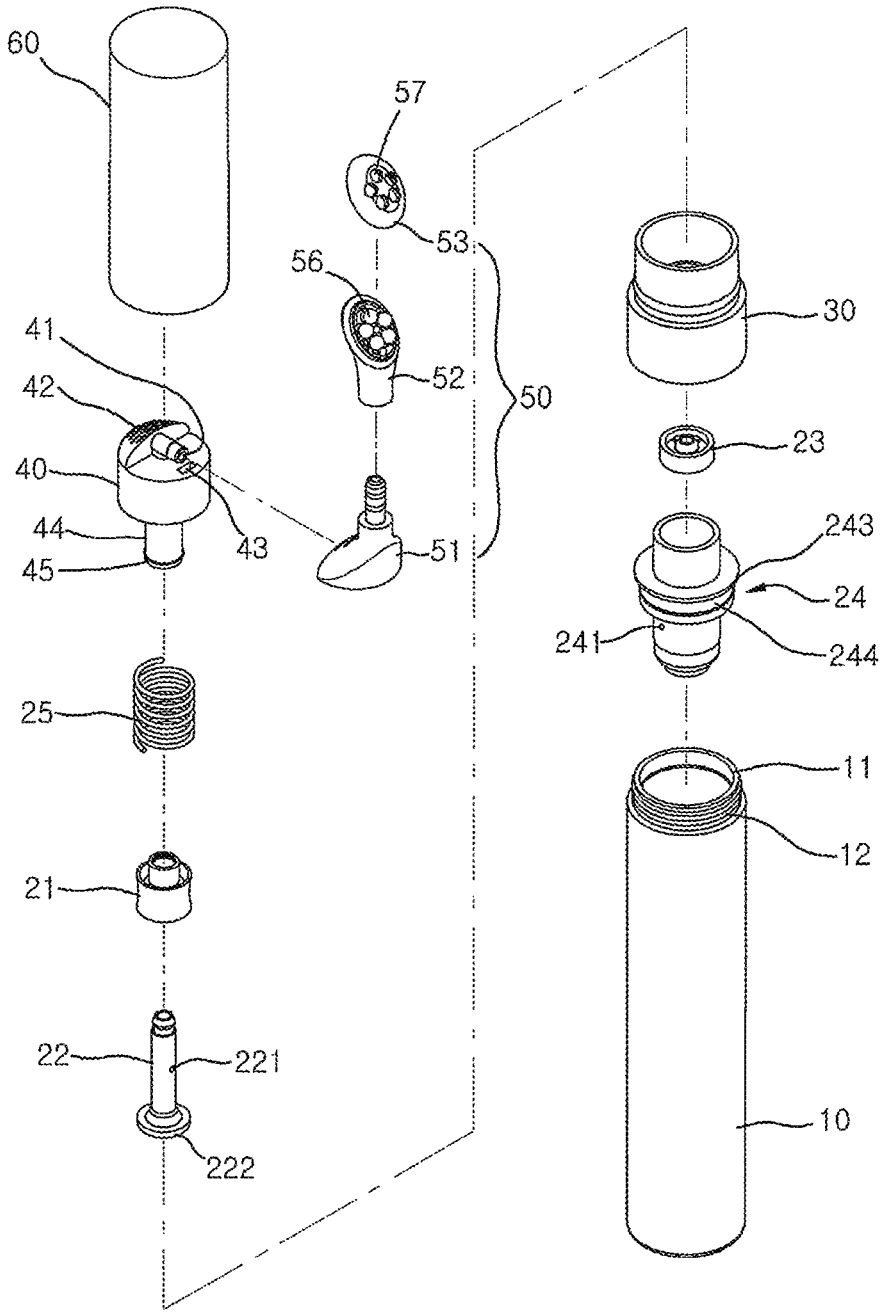
FIG. 3 is an exploded perspective view illustrating a cosmetic container having an application member detachably attached to the side of a button member according to one embodiment of the present invention.
Figure 4:
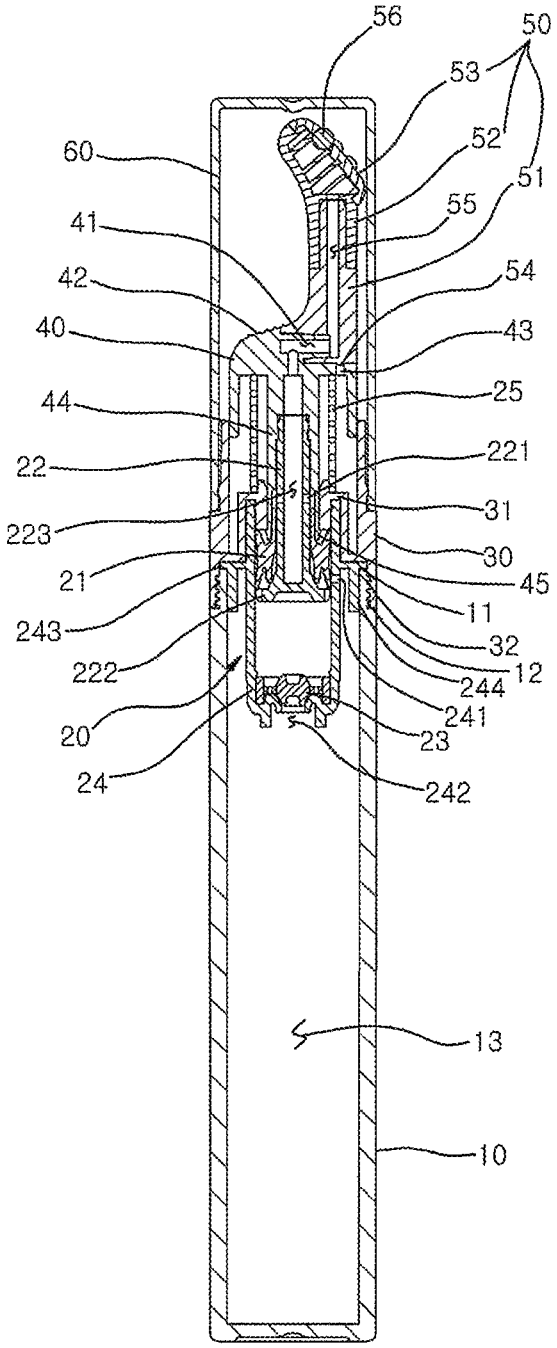
FIG. 4 is a sectional view illustrating a cosmetic container having an application member detachably attached to the side of a button member according to one embodiment of the present invention.
Figure 5:
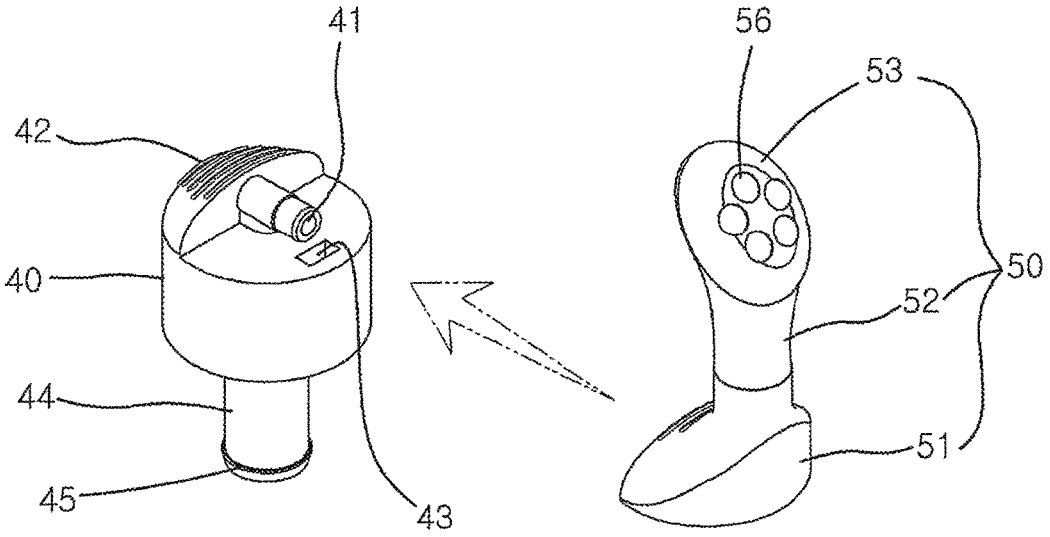
FIG. 5 is a perspective view illustrating a state that a coating member is coupled to a button member of a cosmetic container having an application member detachably attached to the side of a button member according to one embodiment of the present invention.
Figure 6:
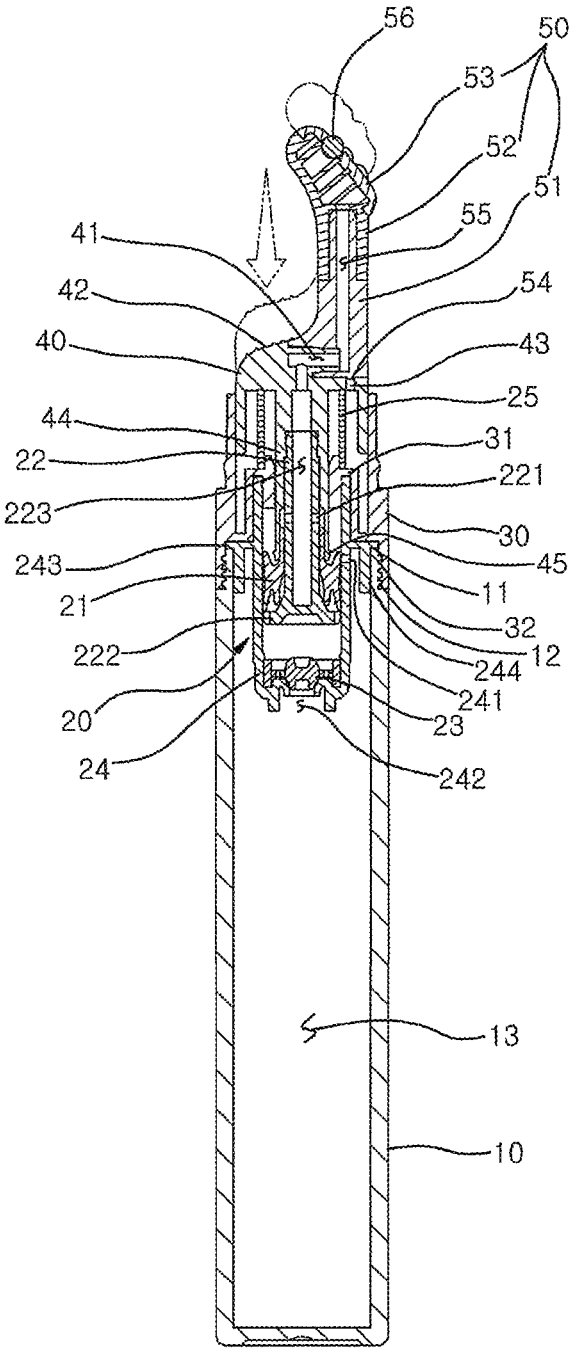
FIG. 6 is a sectional view illustrating a state that a button member of a cosmetic container having an application member detachably attached to the side of a button member according to one embodiment of the present invention is pressed.
Figure 7:
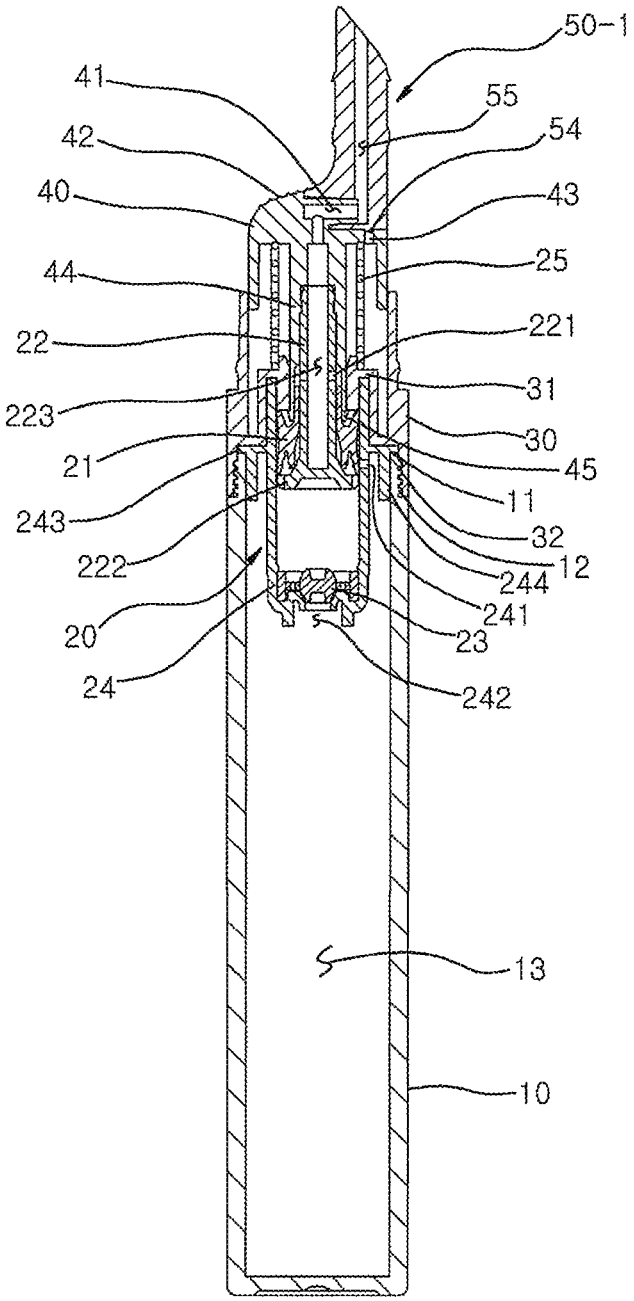
FIG. 7 is a sectional view illustrating a cosmetic container having an application member detachably attached to the side of a button member according to another embodiment of the present invention.

FIG. 2 is a perspective view illustrating a cosmetic container having an application member detachably attached to the side of a button member according to one embodiment of the present invention. FIG. 3 is an exploded perspective view illustrating a cosmetic container having an application member detachably attached to the aide of a button member according to one embodiment of the present invention. FIG. 4 is a sectional view illustrating a cosmetic container having an application member detachably attached to the side of a button member according to one embodiment of the present invention. FIG. 5 is a perspective view illustrating a state that a coating member is coupled to a button member of a cosmetic container having an application member detachably attached to the side of a button member according to one embodiment of the present invention. FIG. 6 is a sectional view illustrating a state that a button member of a cosmetic container having an application member detachably attached to the side of a button member according to one embodiment of the present invention is pressed. FIG. 7 is a sectional view illustrating a cosmetic container having an application member detachably attached to the side of a button member according to another embodiment of the present invention.

According to the present invention, a cosmetic container having an application member detachably attached to a side of a button member includes a container body 10 having a storage space 13, a pump 20 for discharging contents of the container body 10 to an outside, a cap 30 for fixing the pump 20 to the container body 10, the button member 40 coupled to an upper part of the pump 20 and formed to protrude upward of the cap 30, and the application member 50 detachably attached to the side of the button member 40.

The container body 10 is provided therein with the storage space 13 for containing contents. An opening 11 through which contents are introduced is formed on the container body 10. A container body screw thread 12 is formed on an outer periphery surface of an upper end of the container body 10.

A cylinder 24 of the pump 20 is latch-coupled to an inside of the opening 11, and the container body screw thread 12 is screw-coupled to the cap 30.

Although the embodiment proposes the container body 10 and the cap 30 screw-coupled to each other, the container body 10 and the cap 30 may be under-cut coupled or forcibly and fittingly coupled to each other.

The pump 20 is used to dispense the contents of the container body 10 to an outside. The pump 20 includes a piston 22, a cylinder 24 having a cylindrical shape to allow the piston 22 to be inserted therein, a piston ring 21 interposed between an outer periphery surface of the piston 22 and an inner periphery surface of the cylinder 24, and a check valve 23 installed in the cylinder 24 and formed on a lower portion of the cylinder 24.

The piston 22 is formed therein with a hollow 223. A first inlet 221, through which the contents are introduced into the hollow 223 is formed on a side surface of the piston 22, and a flange 222 is formed on a lower end of the piston 22.

The button member 40 communicating with the hollow 223 of the piston 22 is assembled with an upper portion of the piston 22. Thus, as the button member 40 moves up or down, the piston 22 moves up or down together with the piston 22.

An air hole 241 is formed on a side surface of the cylinder 24 and the cylinder 24 is fitted with an inner wall 31 of the cap 30.

The cylinder 24 is provided on an outer surface thereof with a latching ring sill 243 and a sealing wall 244 is formed below the latching ring sill 243.

The piston fitted with the piston ring 21 is inserted into the cylinder 24 so that the piston 22 may move up or down in the cylinder 24. A second inlet 242 is formed oil a lower portion of the cylinder 24 such that the contents contained in the container body 10 may be introduced into the cylinder 24 therethrough. In this case, the check valve 23 is installed at the second inlet 242 of the cylinder 24, such that the contents introduced into the cylinder 24 is prevented from flowing backward.

A vacuum pressure is generated in the air hole 241 of the cylinder 24 as the contents of the container body 10 are discharged. Due to the vacuum pressure, external air is introduced into the container body 10 through the air hole 241 formed in the cylinder 24.

The latching ring sill 243 is formed on an outer periphery surface of the cylinder 24 and is latch-coupled into the opening 11 of the container body 10.

The sealing wall 244 is formed below the latching ring sill 243. When the latching ring sill 243 is latch-coupled into the opening 11, the sealing wall 244 is fittingly coupled to an inner wall of the opening 11 such that the contents of the container body 10 are prevented from being leaked to an outside.

The piston ring 21 is fitted onto the outer periphery surface of the piston and disposed on an upper portion of the flange 222 of the piston 22.

Thus, as the piston 22 moves down, a gap is generated between the flange 222 of the piston 22 and the piston ring 21 so that a content discharging passage is generated. As the piston moves up, the flange 222 of the piston 22 and the piston, ring 21 is tightly closed to each other so that the content discharging passage is shut off.

The cap 30 fixes the pump 20 to the container body 10 and is screw coupled to the container body 10.

The cap 20 is formed at inner side thereof with an inner wall 31 and on an inner periphery surface of a lower end thereof with a cap screw thread 32.

The inner wall 31 is fitted with the cylinder 24 and presses the latching ring sill 243 of the cylinder 24 so that, the air tightness of the container body 10 is improved.

The cap screw thread 32 is coupled to the container body screw thread 12 of the container body 10 to fix the pump 20 to the container body 10.

An elastic member 25 is placed on an upper surface of the inner wall of the cap 30.

The elastic member 25 is located between the button member 40 and the inner wall 31 of the cap 30 to elastically support the pumping operation of the button member 40.

The button member 40 is formed therein with a first outlet 41, on an upper surface thereof with a push protrusion 42, and at one side thereof with a latching groove 43.

The first outlet 41 communicates with a second outlet of the application member 50 to discharge the contents of the container body 10 to an outside.

The push protrusion 42 is formed on the upper surface of the button member 40, such that a user may perform a pumping operation without sliding on the button member 40 when the user performs the pumping operation for using the eye cream container according to the present invention.

The push, protrusion 42 may be separately formed on the upper surface of the button member 40, or alternatively, like the embodiment, may be integrated with the upper surface of the button member 40.

The latching groove 43 is formed at an opposite side to the push protrusion 42 to allow the application member 50 to be latch-fixed to the button member 40.

The button member (40) is provided at a lower side thereof with a lower extension part 44 and a latching ring protrusion 45 is formed on an end of the lower extended part 44.

The piston 22 is fittingly coupled to an inside of the lower extension part 44, and the contents discharged through the hollow 223 are discharged to the first outlet formed in the button member 40.

The latching ring protrusion 45 is formed on the end of the lower extension part 44 and is latch-coupled to the inner wall 31 of the cap 30 such that the button member 40 is prevented from being separated from the cap 30.

The application member 50 includes a coupling part 51, an ejection part 52 coupled to an upper end of the coupling part 51, and an application surface 53 coupled to an upper end of the ejection part 52. The application member so is provided at a lower side thereof with a latching protrusion 54.

The latching protrusion 54 is formed below the coupling part 51, and a second outlet 55 is formed in the coupling part 51.

The coupling part 51 of the application member 50 is fitted onto a side surface of the first outlet 41 of the button member 40. The latching protrusion 54 formed below the application member 50 is latch-coupled to the latching groove 43 of the button member 40 to fixedly couple the application member 50 to the button member 40.

The second outlet 55 is formed in the coupling part 51 of the application member 50. After the contents of the container body 10 are discharged through the first outlet 41 formed in the button member 40, the contents are discharged through the second outlet 55 of the application member 50 to an outside.

The ejection part 52 is fittingly coupled to the upper end of the coupling part 51 and a plurality of massage balls 56 are mounted on an upper end of the ejection part 52.

The contents discharged through the second outlet 55 ooze between massage balls 56 and are applied onto a skin through the application surface 53 fittingly coupled to the upper end of the ejection part 52.

A plurality of mounting holes 57 for fixing the massage balls 56 are formed inside the application surface 53.

According to the embodiment of the present invention, the application member 50 on which the application 53 and the massage balls 56 are formed together with each other is provided, so that the contents are applied on an application portion and at the same time, the massage is conveniently operated.

In addition, according to the embodiment of the present invention, although the application member 50 includes the coupling part 51, the ejection part 52 coupled to the upper end of the coupling part 51, and an application surface 53 coupled to the upper end of the ejection part 52, as shown in FIG. 7, according to another embodiment, the second outlet 55 may be formed in the application member 50 and an integral application member 50-1 in which the coupling part, the ejection part and the application surface are integrally formed may be coupled to the button member 40.

That is, since the integral application member 50-1 is detachably attached to a side surface of the button member 40 to be simply assembled, the integral application member 50-1 is suitable for small quantity batch production. In addition, the process is simple so that the producing speed may be increased, thereby reducing the manufacturing cost.

To prevent the application member 50 or the integral application member 50-1 from being polluted due to the exposure to an outside, a container cap 60 is coupled to an outer periphery surface of the cap 30 so that the application member 50 or the integral application member 50-1 is prevented from being exposed to an outside.

Hereinafter, the assembling method and the using state of the cosmetic container having an application member detachably attached to a side of a button member according to an embodiment of the present invention will be described in detail.

Contents are injected into the container body 10 to assemble the cosmetic container including the application member detachably attached to the side surface of the button member according to the present invention.

Then, after the pump 20 is coupled and assembled, the pump 20 is mounted on the tipper end of the container body 10.

Next, after the inner wall 31 of the cap 30 is fitted with the pump 20, the cap 30 is fixedly coupled to the container body 10.

In addition, after the elastic member 25 is inserted into the upper end of the inner wall 31, the button member 40 is fittingly coupled.

The application member 50 is fittingly coupled to the side surface of the button member 40, so that the assembly of the cosmetic container having an application member detachably attached to a side of a button member according to the present invention is completed.

According to the cosmetic container having an application member detachably attached to a side of a button member assembled according to the method described above, as shown in FIG. 6, when the button member 40 is pressed, the piston 22 of the pump 20 is pressed downward. In this case, since the push button 42 is formed on the upper surface of the button member 40, when a user pushes the button member 40, the button member 40 may be smoothly pressed without sliding. In the state that the piston 21 fittingly installed to the outer periphery surface of the piston 22 is stopped due to the friction against the inner side wall of the cylinder 24, when the piston 22 moves down, the passage through which the contents are discharged may be generated while a gap is generated between the flange 222 of the piston 22 and the piston ring 21.

Thereafter, when the piston 22 further moves down, the piston ring 21 moves down together while the end of the button member 40 makes contact with the piston ring 21, so that the volume of the cylinder 24 is reduced. Thus, the contents in the cylinder 24 are pushed to be discharged through the gap between the flange 222 of the piston 22 and the piston ring 21, so that the contents pass through the first outlet 41 of the button member 40 via the hollow 223 after passing through the first inlet 221 and then, are discharged to an outside through the second outlet 55 of the application member 50 fittingly coupled to the side surface of the button member 40.

In this case, since the application member 50 includes the application surface 53 and the massage balls 56 installed into the mounting hole 57 of the application surface 53, the massage is performed as soon as the contents are applied on the application portion.

In addition, since the integral application member 50-1 is detachably attached to the side surface of the button member 40 to be simply assembled, as shown in FIG. 7, when the integral application member 50-1 is produced in another form, the process is simple so that the producing speed of the cosmetic container is increased, thereby reducing the producing cost.

As described above, the cosmetic container halving an application member detachably attached to a side of a button member described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Container body
11: Opening
12: Container body screw thread
20: Pump
21: Piston ring
22: Piston
221: First inlet
222: Flange
223: Hollow
23: Check valve
24: Cylinder
241: Air hole
242: Second inlet
243: Latching ring sill
244: Sealing wall

25: Elastic member
30: Cap
31: Inner wall
32: Cap screw thread
40: Button member
41: First outlet
42: Push protrusion
43: Latching groove
44: Lower extension part
45: Latching ring protrusion
50: Application member
50-1: Integral application member
51: Coupling part
52: Ejection part
53: Application surface
54: Latching protrusion
55: Second outlet
56: Massage ball
57: Mounting hole
60: Container cap

The invention claimed is:

1. A cosmetic container having an application member detachably attached to a side of a button member, the cosmetic container comprising:
- a container body (10) having a storage space (13);
- a pump (20) for discharging contents of the container body (10);
- a cap (30) for fixing the pump (20) to the container body (10);
- the button member (40) coupled to an upper part of the pump (20) and formed to protrude upward of the cap (30); and
- the application member (50) detachably attached to the side of the button member (40),
- wherein the button member (40) comprises:
  - a first outlet (41) through which discharging contents from the pump (20) passes; and
  - a push protrusion (42) on an upper surface of the button member (40), and
- wherein the application member (50) comprises a second outlet (55) through which discharging contents from the first outlet (41) passes.

2. The cosmetic container of claim 1, wherein the pump (20) comprises a piston (22), a cylinder (24) having a cylindrical shape to allow the piston (22) to be inserted therein, a piston ring (21) interposed between an outer periphery surface of the piston (22) and an inner periphery surface of the cylinder (24), and a check valve (23) installed in the cylinder (24) and formed on a lower portion of the cylinder (24).

3. The cosmetic container of claim 1, wherein the button member (40) further comprises a latching groove (43) at one side of the button member (40).

4. The cosmetic container of claim 1, wherein the button member (40) further comprises:
- a lower extension part (44) at a lower side of the button member (40); and
- a latching ring protrusion (45) formed on an end of the lower extension part (44).

5. The cosmetic container of claim 1, wherein the application member (50) comprises a coupling part (51), an ejection part (52) coupled to an upper end of the coupling part (51), and an application surface (53) coupled to an upper end of the ejection part (52).

6. The cosmetic container of claim 1, wherein the application member (50) is provided at a lower side thereof with a latching protrusion (54).

7. The cosmetic container of claim 1, wherein the application member (50), which is detachably attached to the side surface of the button member (40), is replaced with an integral application member (50-1), and wherein the integral application member (50-1) comprises a coupling part (51), an ejection part (52) and an application surface (53) which are integrated with each other, and is coupled to the button member (40).

8. A cosmetic container comprising an application member detachably attached to a side of a button member,
- wherein a pump (20) is mounted on a container body (10),
- a cap (30) is fixedly coupled to the container body (10) while covering an upper end of the pump (20),
- a button member (40) is fittingly coupled to the cap (30) while an elastic member (25) is inserted into an upper end of the cap (30), and
- an application member (50) is fittingly coupled to a side surface of the button member (40),
- wherein the button member (40) comprises:
  - a first outlet (41) through which discharging contents from the pump (20) passes; and
  - a push protrusion (42) on an upper surface of the button member (40), and
- wherein the application member (50) comprises a second outlet (55) through which discharging contents from the first outlet (41) passes.

9. The cosmetic container of claim 8, wherein the pump (20) comprises a piston (22), a cylinder (24) having a cylindrical shape to allow the piston (22) to be inserted therein, a piston ring (21) interposed between an outer periphery surface of the piston (22) and an inner periphery surface of the cylinder (24), and a check valve (23) installed in the cylinder (24) and formed on a lower portion of the cylinder (24).

10. The cosmetic container of claim 8, wherein the button member (40) further comprises a latching groove (43) at one side of the button member (40).

11. The cosmetic container of claim 8, wherein the button member (40) further comprises:
- a lower extension part (44) at a lower side of the button member (40); and
- a latching ring protrusion (45) formed on an end of the lower extension part (44).

12. The cosmetic container of claim 8, wherein the application member (50) comprises a coupling part (51), an ejection part (52) coupled to an upper end of the coupling part (51), and an application surface (53) coupled to an upper end of the ejection part (52).

13. The cosmetic container of claim 8, wherein the application member (50) is provided at a lower side thereof with a latching protrusion (54).

14. The cosmetic container of claim 8, wherein the application member (50), which is detachably attached to the side surface of the button member (40), is replaced with an integral application member (50-1), and wherein the integral application member (50-1) comprises a coupling part (51), an ejection part (52) and an application surface (53) which are integrated with each other, and is coupled to the button member (40).

* * * * *